US012442624B2

(12) United States Patent
Murarash et al.

(10) Patent No.: US 12,442,624 B2
(45) Date of Patent: Oct. 14, 2025

(54) INTEGRATED AMMUNITION CARTRIDGE

(71) Applicant: IMI SYSTEMS LTD., Ramat Hasharon (IL)

(72) Inventors: Boris Murarash, Ramat Hasharon (IL); Ariel Gershonsky, Ramat Hasharon (IL)

(73) Assignee: IMI SYSTEMS LTD., Ramat Hasharon (IL)

( * ) Notice: Subject to any disclaimer, the term of this patent is extended or adjusted under 35 U.S.C. 154(b) by 0 days.

(21) Appl. No.: 18/944,817

(22) Filed: Nov. 12, 2024

(65) Prior Publication Data

US 2025/0067544 A1 Feb. 27, 2025

Related U.S. Application Data

(63) Continuation of application No. PCT/IL2023/050483, filed on May 10, 2023.

(30) Foreign Application Priority Data

May 11, 2022 (IL) ..... 292942

(51) Int. Cl.
*F42B 5/067* (2006.01)
*F42B 5/28* (2006.01)

(52) U.S. Cl.
CPC ..... *F42B 5/067* (2013.01); *F42B 5/28* (2013.01)

(58) Field of Classification Search
CPC .. F42B 5/30; F42B 5/307; F42B 5/067; F42B 8/00
See application file for complete search history.

(56) References Cited

U.S. PATENT DOCUMENTS 2,654,319 A * 10/1953 Roske ..... F42B 5/307 102/467
2,862,446 A * 12/1958 Ringdal ..... F42B 5/067 102/466
3,099,958 A * 8/1963 Daubenspeck ..... F42B 7/06 86/19.5

(Continued)

FOREIGN PATENT DOCUMENTS

DE 1254051 11/1967

*Primary Examiner* — Derrick R Morgan
(74) *Attorney, Agent, or Firm* — PEARL COHEN ZEDEK LATZER BARATZ LLP

(57) ABSTRACT

According to some embodiments of the present invention, an ammunition cartridge is provided herein. The ammunition cartridge may include a cartridge enclosure comprising a cartridge case portion and a jacket portion, wherein the jacket portion is configured to accommodate at least one projectile filling; and a base, connectable to the cartridge enclosure, wherein the base comprises an ignition device, wherein the cartridge enclosure comprises a section configured to control the detachment of at least some of the jacket portion from the cartridge case. According to some embodiments of the present invention, another ammunition cartridge is provided herein. The ammunition cartridge may include: a cartridge case portion; and a jacket portion, wherein the jacket portion is configured to accommodate at least one projectile filling, wherein the jacket portion is made of at least one of: polymer material, and composite material.

12 Claims, 5 Drawing Sheets

(56) References Cited

U.S. PATENT DOCUMENTS 3,146,712 A * 9/1964 Eisinger ..... F42B 5/067 102/444
3,732,826 A * 5/1973 Johnson ..... F42B 5/025 102/466
3,935,816 A * 2/1976 Boquette, Jr. ..... F42B 5/067 102/466
4,142,466 A 3/1979 Ballreich et al.
4,497,239 A * 2/1985 Curry ..... F42B 5/105 89/14.6
4,546,704 A * 10/1985 Ballreich ..... F42B 8/02 102/501
4,565,131 A * 1/1986 Buchner ..... F42B 5/30 102/466
4,593,621 A * 6/1986 Buchner ..... F42B 5/30 102/466
4,682,545 A * 7/1987 Jett, Jr. ..... F42B 5/36 102/501
4,726,296 A * 2/1988 Leshner ..... F42B 5/02 102/467
4,809,612 A * 3/1989 Ballreich ..... F42B 8/04 102/466
4,958,567 A * 9/1990 Olson ..... F42B 8/02 102/447
5,151,555 A * 9/1992 Vatsvog ..... F42B 5/307 86/10
7,213,519 B2 * 5/2007 Wiley ..... B29C 66/1224 102/467
7,314,006 B1 * 1/2008 Georgantzis ..... F42B 12/46 102/498
7,610,858 B2 * 11/2009 Chung ..... F42B 5/313 102/466
8,186,273 B2 * 5/2012 Trivette ..... F42B 8/04 102/466
9,933,241 B2 * 4/2018 Burrow ..... F42B 5/307
10,466,022 B2 * 11/2019 Peterson ..... F41A 11/02
10,794,671 B2 * 10/2020 Padgett ..... F42B 5/307
2001/0013299 A1 8/2001 Husseini et al.
2005/0081704 A1 4/2005 Husseini
2005/0257712 A1 11/2005 Husseini et al.
2009/0044717 A1 * 2/2009 Husseini ..... F42B 5/067 102/466
2014/0060372 A1 3/2014 Padgett
2019/0137228 A1 5/2019 Burrow et al.
2020/0080803 A1 * 3/2020 Peterson ..... F41A 3/54

* cited by examiner

INTEGRATED AMMUNITION CARTRIDGE

CROSS REFERENCE TO RELATED APPLICATION

This application is a Continuation application of PCT Application No. PCT/IL2023/050483 filed on May 10, 2023, which claims priority from Israeli Patent Application No. 292942 filed on May 11, 2022, which is incorporated herein by reference in its entirety.

FIELD OF THE INVENTION

The present invention relates to ammunition cartridges. More particularly, the present invention relates to integrated ammunition cartridges.

BACKGROUND OF THE INVENTION

FIG. 1 illustrates a conventional ammunition article according to the prior art. Conventional ammunition article typically includes four basic and separate components, that is: the projectile 14, the cartridge case 10 holding projectile 14 therein, a primer 11, and a propellant 12, wherein a primer 11 provides the spark needed to ignite propellant 12 used to build a pressure and push projectile 14 down the barrel at predetermined velocities.

The cartridge components are manufactured in separate processes and then joined together and sealed with a sealing compound 18 for the purpose of meeting environmental and shelf-life requirements of ammunition.

The primary objective of the cartridge case 10 is to hold the projectile 14, primer 11, and propellant 12 therein until the gun is fired. Upon firing of the gun, the cartridge case 10 seals the chamber to prevent hot gases from escaping the chamber in a rearward direction. The empty cartridge case is extracted from the chamber once the gun is fired.

Cartridge case 10 is configured to hold projectile 14 by crimping or adherent connection 18 (between the case mouth and the bullet) to create a predetermined resistance, which is known in the industry and defined in the standards as bullet pull force. The bullet pull force is uninform due to tolerance differences between the two separated components (bullet and case) and due to crimping deviation and thus effect the ballistic performance of the cartridge.

Most of the current cartridge cases are formed from metals (brass, steel etc.) and some are made from polymeric or composite materials or based on them. The cartridge cases can have variety shapes and configurations, depending on the caliber of the ammunition.

The structure of the projectile usually includes a metal jacket (brass, or steel) and at least one core which integrated into it. The ballistics performance of the ammunition cartridges are significantly affected by the geometry of the projectile and by the type and number of the cores or projectile fillings integrated in it. For example, a different ballistic performance is required for different kind of ammunition: armor piercing, sniper ammunition or high stopping power and the like.

It should be noted that currently available manufacture process of the metal jackets is limiting the variety of possible geometries and shapes of the bullets.

SUMMARY OF THE INVENTION

In order to address the aforementioned challenges of the conventional ammunition cartridge, it is an object of some embodiments of the present invention to provide a structure of ammunition cartridge which may include an enclosure in which the case and the jacket portions form a single part. The ammunition structure in accordance with some embodiments of the present invention give rise to numerous advantages and may eliminate many potential failures of ammunition, for example, improper cartridge sealing, elimination of bullet pull-force deviation, flexibility in the bullet shape geometry, reduction of the manufacturing stages/cost and the like.

According to some embodiments of the present invention, an ammunition cartridge is provided herein. The ammunition cartridge may include a cartridge enclosure comprising a cartridge case portion and a jacket portion, wherein the jacket portion is configured to accommodate at least one projectile filling, wherein the cartridge case portion is suitable for accommodating propellent powder; and a base, connectable to the cartridge enclosure, wherein the base is configured to accommodate an ignition device, wherein the base is a distinct element from the cartridge enclosure, wherein the cartridge enclosure comprises a section configured to control the detachment of at least some of the jacket portion from the cartridge.

According to some embodiments of the present invention, another ammunition cartridge is provided herein. The ammunition cartridge may include: a cartridge case portion suitable for accommodating propellent powder; and a jacket portion, wherein the jacket portion accommodates at least one projectile filling, wherein the jacket portion is made of at least one of: polymer material, and composite material.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
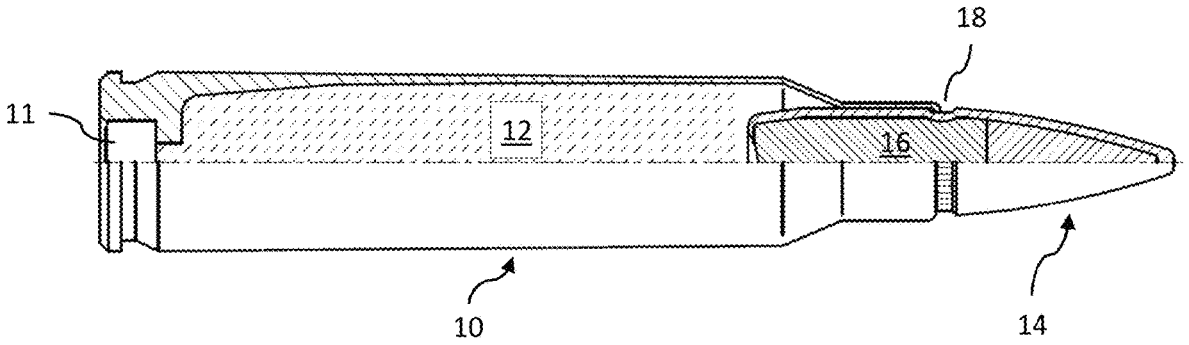
Figure 1 (Prior Art)
FIG. 1 illustrates a conventional ammunition cartridge according to the prior art.

It will be appreciated that, for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following detailed description, numerous specific details are set forth in order to provide a thorough understanding of the invention. However, it will be understood by those skilled in the art that the present invention may be practiced without these specific details. In other instances, well-known methods, procedures, and components, modules, units and/or circuits have not been described in detail so as not to obscure the invention. Some features or elements described with respect to one embodiment may be combined with features or elements described with respect to other embodiments. For the sake of clarity, discussion of same or similar features or elements may not be repeated.

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. The term set when used herein may include one or more items.

Unless explicitly stated, the method embodiments described herein are not constrained to a particular order or sequence. Additionally, some of the described method embodiments or elements thereof can occur or be performed simultaneously, at the same point in time, or concurrently.

Prior to setting forth the detailed description of the invention, it may be helpful to provide definitions of certain terms which will be used hereinafter.

The term "ammunition cartridge" or simply "cartridge" as used herein relate to pre-assembled firearm ammunition article which packages together a projectile (bullet, shot, or slug), a propellant substance and an ignition device within a metallic, paper, or polymeric case that is precisely made to fit within the barrel chamber of a breechloading gun, for the practical purpose of convenient transportation and handling during shooting.

The term "cartridge case" is a portion of an article of ammunition which remains at the firearm and ejected therefrom after the projectile has been discharged from the cartridge upon combustion of the propellant.

The term "projectile" as used herein is defined as a portion that is detached from the cartridge upon combustion of the propellent and which is effectively fired out of the firearm's barrel.

The term "enclosure" or "cartridge enclosure" is a portion of the ammunition cartridge which is attached to the base on one end and contains the propellant and is configured to discharge the projectile upon combustion of the propellant.

The terms "projectile core" or "projectile filling" or simply "filling" as used herein are defined as one or more portions or materials which fill the distal part of the enclosure opposite the base or the ignition device and forms a major part of the projectile, together with the jacket portion (see definition below). The projectile filling may include a projectile core possibly made of metal and can include several cores or materials including explosive or pyrotechnic substance such as the one used in a tracer.

The term "jacket portion" as used herein is a portion of the enclosure which accommodates the projectile filling and has a direct contact with the projectile filling. Upon combustion of the propellent, at least some of the jacket portion remains attached to the projectile filling and both projectile filling and detached jacket form together the projectile.

The term "case portion" as used herein is a portion of the enclosure which accommodates the propellant and has a direct contact with the cartridge base. Upon combustion of the propellent, at least some of the jacket portion is detached from the case portion.

According to some embodiments, apparatuses, systems are provided for an ammunition cartridge with a single enclosure to accommodate the projectile core and the propellant. The enclosure may be of a lightweight material such as a polymer, and connect to a base (e.g., metallic base or polymeric base). In order to detach the projectile—from the cartridge, a dedicated section may be positioned along the cartridge.

Figure 2:
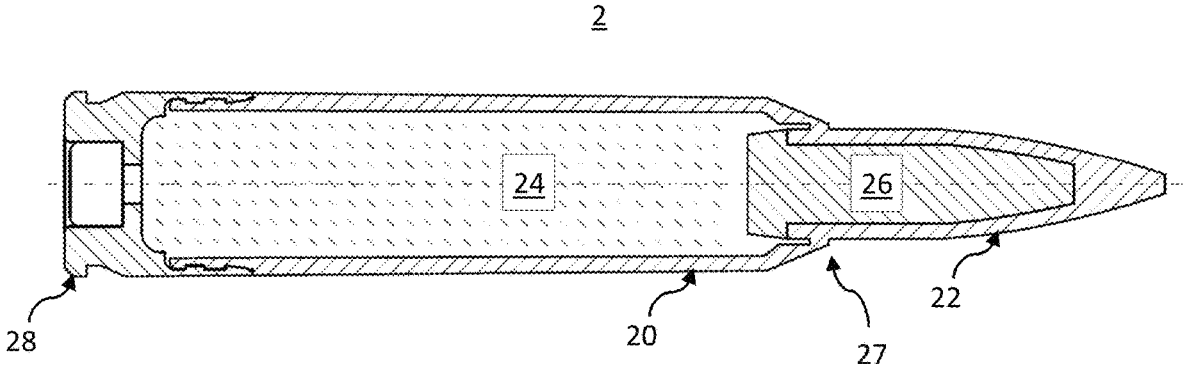
FIG. 2 illustrates an assembled ammunition having a monolithic enclosure, a base, a projectile core and a propellant, according to some embodiments of the present invention.

FIG. 2 illustrates an integrated ammunition cartridge 2 having a case portion 20 and jacket portion 22 forming together the cartridge enclosure (element 3 in FIG. 3 below) according to some embodiments of the invention. Ammunition cartridge 2 may include a cartridge base 28 connectable to the case portion 20, where the base 28 is configured to accommodate an ignition device/primer (not shown here) therein.

In some embodiments, the enclosure having case portion 20 and jacket portion 22 is made of at least one of: a polymer, a composite material, and a metal. The cartridge enclosure may be manufactured by at least one of: injection, mold injection, over-mold injection, extrusion, casting, plastic processing, metal forming, machining, and 3D printing.

In some embodiments, the cartridge enclosure may be manufactured of the same material in different conditions, for example: different cycle times and/or at different temperatures, such that different portions are connected together.

In some embodiments, cartridge case portion 20 is suitable for accommodating propellent powder and base 28 is a distinct element from the cartridge enclosure 3. The suitability of cartridge case portion 20 is a structural feature and may require for example that when the powder is inserted during manufacturing, the cartridge case portion 20 is in a rigid form.

In some embodiments, various portions of the cartridge enclosure may be manufactured separately and connected afterwards, or at minimum, manufactured as rigid elements irrespective of the propellent.

Advantageously, having the enclosure as a standalone part allows filling it with one or more types of projectile and various types of propellent as needed, including propellent powder and/or explosive powder.

The cartridge enclosure may include case portion 20 which contains propellant 24 and a jacket portion 22 which contains a projectile filling 26. Jacket portion 22 may be configured to accommodate at least one projectile core or filling 26 and the case portion 20 may be configured to accommodate the propellant 24. Accordingly, the cartridge enclosure may accommodate the at least one projectile core 26 and also the propellant 24 within a monolithic enclosure.

Depending on the purpose and required performance of the ammunition cartridge 2, for instance a sniper, armor piercing or increased stopping power capabilities, jacket portion 22 may accommodate one or many combination of the following projectile fillings: cores or pellets of different shape and material, explosive, incendiary, tracer and the like. In some embodiments the jacket portion 22 may accommodate a projectile filling as a full caliber projectile or a sub-caliber projectile, where jacket portion 22 may function as a sabot.

According to some embodiments, the cartridge enclosure may include a detachment section 27 configured to control the detachment of at least some of jacket portion 22 from the case portion 20. After detachment of jacket portion 22, the detached jacket portion 22 may remain attached to projectile filling or projectile core 26 forming together the projectile as it is shot towards the target.

In some embodiments, detachment section 27 may include an area between the case portion 20 and the jacket portion 22, where this area may not be supported by the chamber of the corresponding firearm so as to allow detachment of at least some of the jacket portion 22 due to dedicated geometry of detachment section 27. In some embodiments, detachment section 27 may include a connecting area of different materials and/or transition area of various manufacturing methods.

For example, detachment section 27 may include a weakened portion (e.g., with a dedicated groove) such that during firing of the ammunition cartridge 2, jacket portion 22 may be detached from the case portion 20 due to the forces applied on the weakened portion.

In a further example, for the weakened portion, detachment section 27 may include a dedicated material having weak structure compared to the cartridge enclosure materials.

Figure 3:
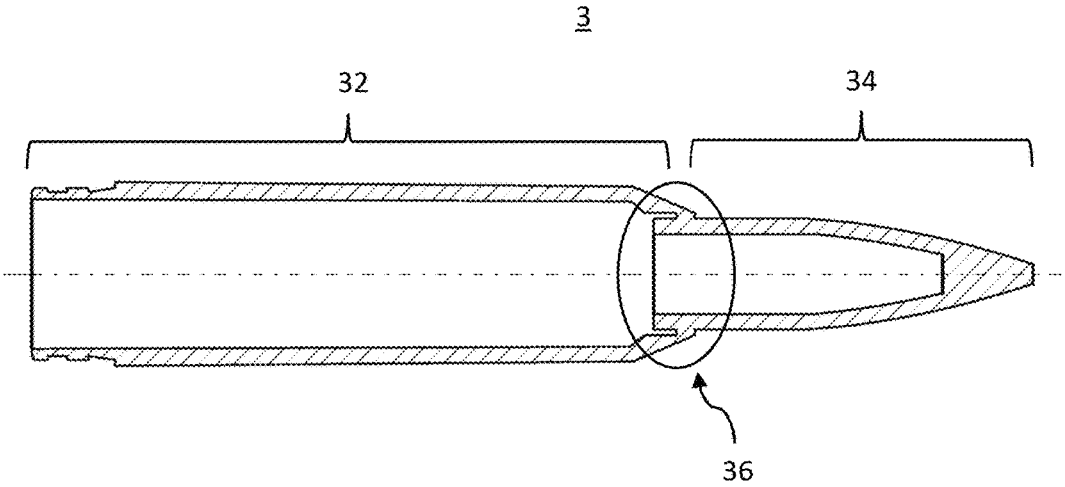
FIG. 3 illustrates a monolithic enclosure for an ammunition cartridge, having a case portion, a jacket portion, and a detachment area therebetween, according to some embodiments of the present invention.

FIG. 3 illustrates a cartridge enclosure 3 according to some embodiments of the invention, cartridge enclosure 3 includes a case portion 32 and a jacker portion 34 attached to each other as monolithic integral part via a detachment section 36.

Figure 4A:
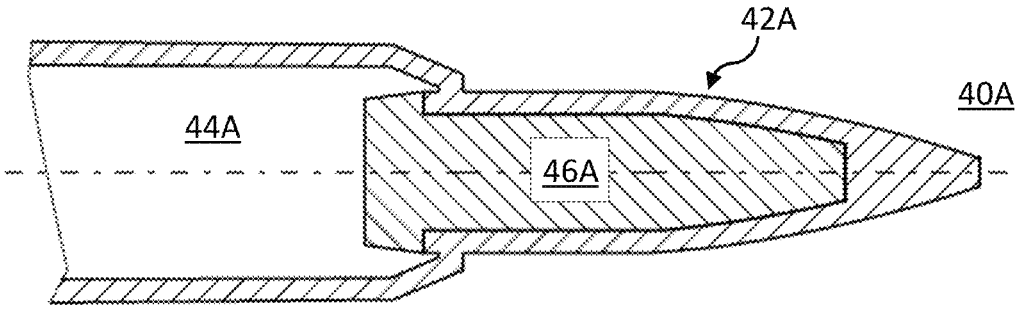
FIG. 4A illustrates a jacket portion which is partially open at the tail of the projectile core, being the side facing the base, according to some embodiments of the invention.
Figure 4B:
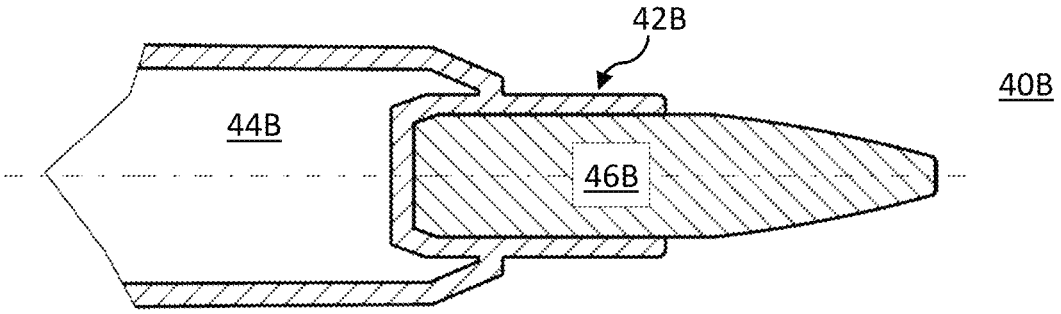
FIG. 4B illustrates a jacket portion which is partially open at the head of the projection core, according to some embodiments of the invention.
Figure 4C:
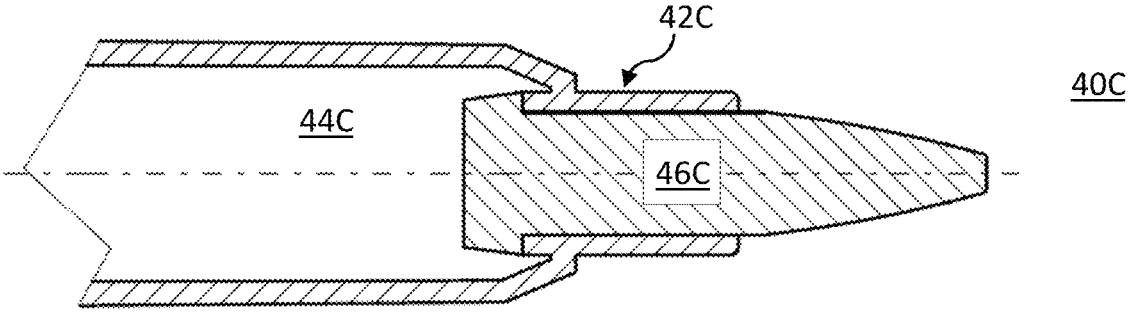
FIG. 4C illustrates a jacket portion which is partially open at the head and at the tail of the projectile filling, according to some embodiments of the invention.

FIGS. 4A-4C illustrate various types of jacket portions varying in the way they embrace the projectile filling therein.

FIG. 4A illustrates a partial view of cartridge enclosure 40A defining a chamber 44A for propellant and a jacket portion 42A which is partially open at the tail of projectile filling 46A, according to some embodiments of the invention. FIG. 4B illustrates a partial view of cartridge enclosure 40B defining a chamber 44B for propellant and a jacket portion 42B which is partially open at the head of projectile filling 46B, according to some embodiments of the invention. FIG. 4C illustrates a partial view of a cartridge enclosure 40C defining a chamber 44C for propellant and a jacket portion 42C which is partially open at the tail and at the head of projectile filling 46C, according to some embodiments of the invention.

According to some embodiments, in a case where the projectile core 46B is configured to form a sabotted sub-caliber projectile, the partially open ammunition enclosure 40B may receive a sabotted projectile core, at the partially open jacket 42B. The partially open jacket portion 42B may be configured to operate as a sabot after detachment from the cartridge enclosure 40B when the projectile core 46B is configured to detach from the partially open jacket 42B such that only the projectile core 46B is at impact with the target. It is noted that enclosure 40C can also operate in a similar manner forming a sabotted projectile.

Figure 5A:
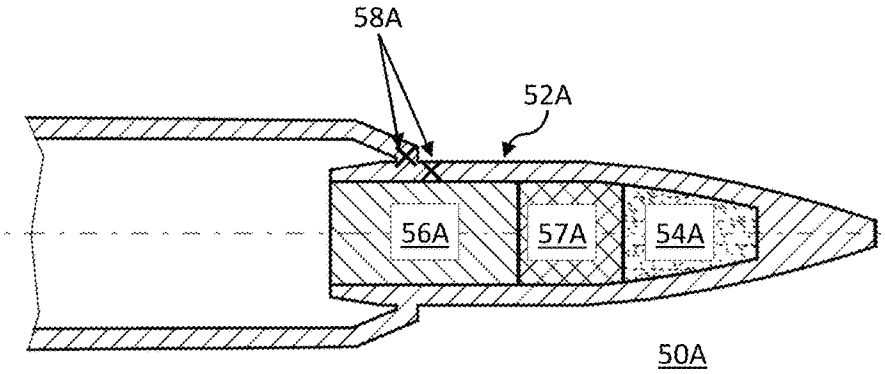
FIGS. 5A-5D illustrate various jacket portions with detachment areas according to various embodiments of the present invention.
Figure 5B:
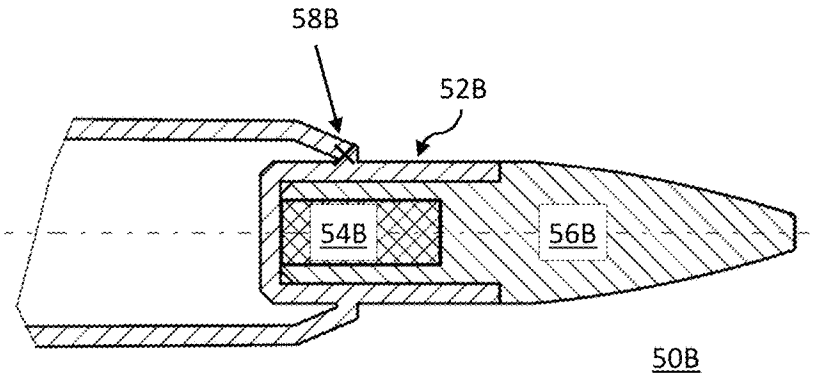

FIGS. 5A-5D illustrate various types of projectile fillings. FIG. 5A illustrates cartridge enclosure 50A with jacket portion 52A encapsulating several projectile fillings (projectile cores) 54A, 56A, and 57A and detachment section 58A. The jacket is open at the tail of projectile filling 56A. FIG. 5B illustrates cartridge enclosure 50B with jacket portion 52B encapsulating several projectile fillings (projectile cores) 54B, 56B, and detachment section 58B. The jacket portion is open at the head of projectile filling 56B. Projectile filling 54B can include tracer composition.

Figure 5C:
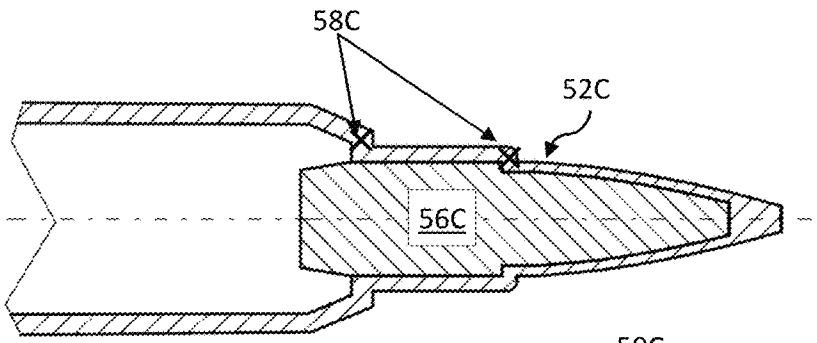
Figure 5D:
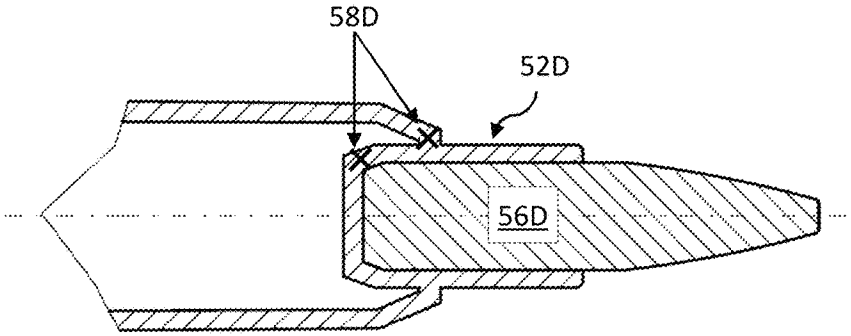

FIG. 5C illustrates cartridge enclosure 50C with jacket portion 52C encapsulating projectile filling 56C and detachment section 58C. The jacket portion is open at the tail of projectile filling 56C. By the aforementioned structure, a full or a sub caliber projectile can be inserted and used by the cartridge as a projectile filling. FIG. 5D illustrates cartridge enclosure 50D with jacket portion 52D encapsulating projectile filling 56D and detachment section 58D. The jacket portion is open at the head of projectile filling 56D. By the aforementioned structure, a full or a sub caliber projectile can be inserted and used by the cartridge as a filling.

According to some embodiments, the cartridge case portion is suitable for accommodating propellent powder as explained above and the jacket portion form together an enclosure which comprises a section configured to control the detachment of at least some of the jacket portion from the cartridge portion.

According to some embodiments of the present invention, the projectile filling may be full caliber—same caliber/diameter as the firearm from which it is fired—or it can be in a sub caliber—caliber/diameter smaller than firearm. It is also noted that detachment section 58A-58D may be positioned on any portion along the cartridge enclosure 50A-50D.

Figure 6B:
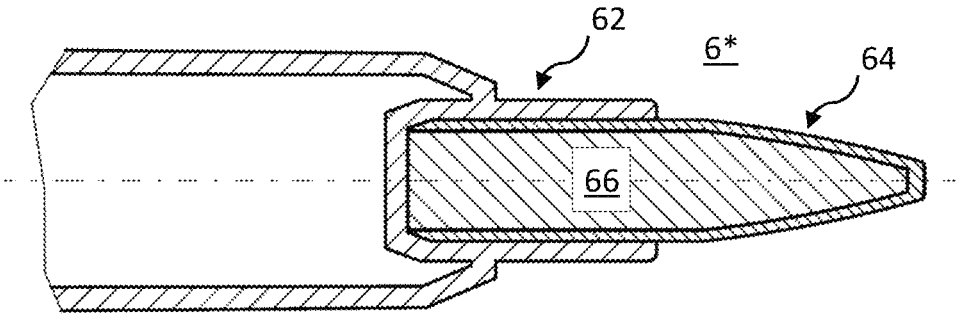
FIG. 6B illustrates the projectile of FIG. 6A attached to a jacket portion of an enclosure for ammunition cartridge according to some embodiments of the present invention.
Figure 6A:
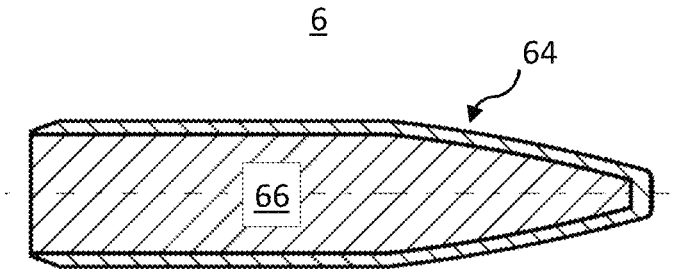
FIG. 6A illustrates a projectile having a projectile filling and a standalone jacket in accordance with some embodiments of the present invention.

FIG. 6A illustrates a projectile 6 having a projectile filling 66 and a standalone jacket 64 in accordance with some embodiments of the present invention. Projectile 6 may include a standalone projectile jacket, i.e., not part of enclosure 62 shown in FIG. 6B. Projectile jacket 64 is configured to accommodate at least one projectile filling 66. Standalone projectile jacket 64 is made of at least one of: polymer material, and composite material.

FIG. 6B illustrates the projectile of FIG. 6A assembled and embraced by a jacket portion of an enclosure 62 for ammunition cartridge according to any of the embodiments of the present invention described above.

While certain features of the invention have been illustrated and described herein, many modifications, substitutions, changes, and equivalents may occur to those skilled in the art. It is, therefore, to be understood that the appended claims are intended to cover all such modifications and changes as fall within the invention.

Various embodiments have been presented. Each of these embodiments may, of course, include features from other embodiments presented, and embodiments not specifically described may include various features described herein.

The invention claimed is:

1. An ammunition cartridge comprising:

a cartridge enclosure comprising a cartridge case portion and a jacket portion, wherein the jacket portion is configured to accommodate at least one projectile filling and wherein the jacket portion of the cartridge enclosure is open at the side of the projectile filling facing a base, wherein the cartridge case portion is suitable for accommodating propellent powder; and the base, connectable to the cartridge enclosure, wherein the base is configured to accommodate an ignition device, wherein the base is a distinct element from the cartridge enclosure, wherein the cartridge enclosure comprises a detachment section, wherein the projectile filling comprises a first portion facing the base radially extending outward into a shoulder that engages with the jacket portion at the detachment section, and a second portion which reduces in diameter in shot direction such that, during firing of the ammunition cartridge, due to pressure forces applied on the detachment section by the propellant powder during combustion thereof, at least some of the jacket portion is detached from the cartridge enclosure and remains attached to the at least one projectile filling, forming together a projectile to be shot towards a target.

2. The ammunition cartridge of claim 1, wherein the jacket portion of the cartridge enclosure is open at the side of the projectile filing opposite to the base.

3. The ammunition cartridge of claim 1, wherein the jacket portion accommodates the at least one projectile filling.

4. The ammunition cartridge of claim 1, wherein the jacket portion is configured to accommodate at least two projectile fillings.

5. The ammunition cartridge of claim 1, wherein the jacket portion is configured to accommodate a projectile filling as a full caliber or a sub caliber projectile.

6. The ammunition cartridge of claim 1, wherein the cartridge enclosure comprises at least one of: a polymer, a composite material, and a metal.

7. The ammunition cartridge of claim 1, wherein the cartridge enclosure is manufactured by at least one of: injection, mold injection, over-mold injection, extrusion, casting, plastic processing, metal forming, machining, and 3D printing.

8. The ammunition cartridge of claim 1, wherein the section comprises a groove.

9. The ammunition cartridge of claim 1, wherein the detachment section comprises a connecting area of different materials or transition area of various manufacturing conditions.

10. The ammunition cartridge of claim 1, wherein the detachment section comprises a dedicated material having weak structure compared to the cartridge enclosure materials.

11. An ammunition cartridge comprising:

a cartridge case portion suitable for accommodating propellent powder; and a jacket portion, wherein the jacket portion is configured to accommodate at least one projectile filling and wherein the jacket portion of the cartridge enclosure is open at the side of the projectile filling facing a base, wherein the jacket portion is made of at least one of: polymer material, and composite material, wherein the cartridge case portion is connectable to the base which is suitable for accommodating an ignition device, wherein the base is a distinct element from the cartridge case portion, and wherein the cartridge enclosure comprises a detachment section, wherein the projectile filling comprises a first portion facing the base radially extending outward into a shoulder that engages with the jacket portion at the detachment section, and a second portion which reduces in its diameter in shot direction, such that, during firing of the ammunition cartridge, due to pressure forces applied on the detachment section by the propellant powder during combustion thereof, at least some of the jacket portion is detached from the cartridge enclosure and remains attached to the at least one projectile filling, forming together a projectile to be shot towards a target.

12. The ammunition cartridge according to claim 11, wherein the cartridge case portion and the jacket portion form together an enclosure which comprises a detachment section configured to control the detachment of at least some of the jacket portion from the cartridge portion.

* * * * *